United States Patent [19]

Palmer

[11] 4,016,927

[45] Apr. 12, 1977

[54] CONDENSER CONTAMINATION REMOVAL ARRANGEMENT

[75] Inventor: William Earl Palmer, Easton, Pa.

[73] Assignee: Ingersoll-Rand Company, Woodcliff Lake, N.J.

[22] Filed: Mar. 12, 1976

[21] Appl. No.: 666,240

[52] U.S. Cl. ..... 165/70; 60/692; 165/13; 165/111; 165/134

[51] Int. Cl.[2] ..... F28F 11/00; F28B 9/08

[58] Field of Search ..... 60/688, 689, 690, 692; 165/13, 70, 111, 134

[56] References Cited

UNITED STATES PATENTS

| | | | |
|---|---|---|---|
| 2,946,571 | 7/1960 | Droescher | 165/111 X |
| 2,984,999 | 5/1961 | Morgan | 165/70 X |
| 3,057,602 | 10/1962 | Stocker et al. | 165/11 |
| 3,063,681 | 11/1962 | Duguid | 165/13 |
| 3,153,329 | 10/1964 | Sebald | 60/692 X |
| 3,590,914 | 7/1971 | Duncan | 165/70 |
| 3,790,345 | 2/1974 | Mansfield et al. | 165/70 X |
| 3,817,323 | 6/1974 | Ebara et al. | 60/692 X |
| 3,919,846 | 11/1975 | Lecocq | 60/690 X |

FOREIGN PATENTS OR APPLICATIONS

| | | | |
|---|---|---|---|
| 165,484 | 7/1921 | United Kingdom | 165/70 |

*Primary Examiner*—C. J. Husar
*Assistant Examiner*—Sheldon Richter
*Attorney, Agent, or Firm*—Frank S. Troidl

[57] ABSTRACT

A surface condenser is separated into a plurality of compartments. Each compartment is provided with tray collecting members for collecting condensed steam. If contaminated condensed steam develops in a particular compartment, the normally used condensed steam outlet is no longer used and the contaminated condensed steam is fed through a normally closed condensed steam conduit and out of the surface condenser housing. The contaminated condensed steam from the emergency outlet is then cleaned-up or sent to a waste disposal area.

Only tne condensed steam from the compartment containing the contaminated condensed steam is removed from the housing. Thus, it is not necessary to shut down the entire surface condenser operation if contamination occurs only in a local area.

4 Claims, 3 Drawing Figures

CONDENSER CONTAMINATION REMOVAL ARRANGEMENT

This invention relates to condensers. More particularly, this invention is a novel structure for detecting and removing contamination from a surface condenser.

It has generally been assumed that contamination of condensed steam occurs in the area where the tubes are connected to the tube sheet. Therefore, currently utilized condenser contamination removal arrangements include a detector for contamination in the area where the tubes are connected to the tube sheet. If contamination is detected in this area, the contaminated liquid is then removed from the systems. Such a currently utilized arrangement is shown and described in U.S. Pat. No. 3,057,602 granted Oct. 9, 1962 to R. J. Stoker, et al. However, it has been found that leakages and the resulting contamination of the condensed steam do not necessarily occur at the juncture of the tubes with the tube sheets. Defects can occur any where along the length of the tubes within the surface condenser.

The present invention is a new surface condenser contamination removal arrangement which includes, among other things, ways to detect the occurance of contamination in a localized area of the surface condenser. The contamination may occur any place along the length of the tubes within the surface condenser and the contamination will be detected. The contaminated condensed steam will be removed only from the local area where the contamination occurs and therefore the surface condenser need not be shut down for repairs immediately upon contamination.

Briefly described, my new invention is a surface condenser having the usual gas inlet and a condensed gas outlet. A plurality of separate compartments is provided in the surface condenser. The hollow tubes over which the gas is flowed and condensed by cooling liquids flowing through the tubes extended through the plurality of separate compartments. Condensed gas collectors such as trays are located in the separate compartments for collecting the condensed gas. A first normally used liquid conduit extends from the condensed gas collectors in each separate compartment to remove the condensed gas from each compartment for reuse. A second liquid conduit having a normally closed valve also extends from the condensed gas collectors. A contamination sensor is located in each of the normally used conduits and adapted to sense any contamination in the liquids flowing through such conduit. Means are responsive to the sensing of contamination by any particular contamination sensor near a particular compartment to open the normally closed valve in the second liquid conduit leading from the same compartment.

The invention as well as its many advantages may be further understood by reference to the following detailed description and drawings in which.

Like parts in the various figures are referred to by like numbers.

Figure 1:
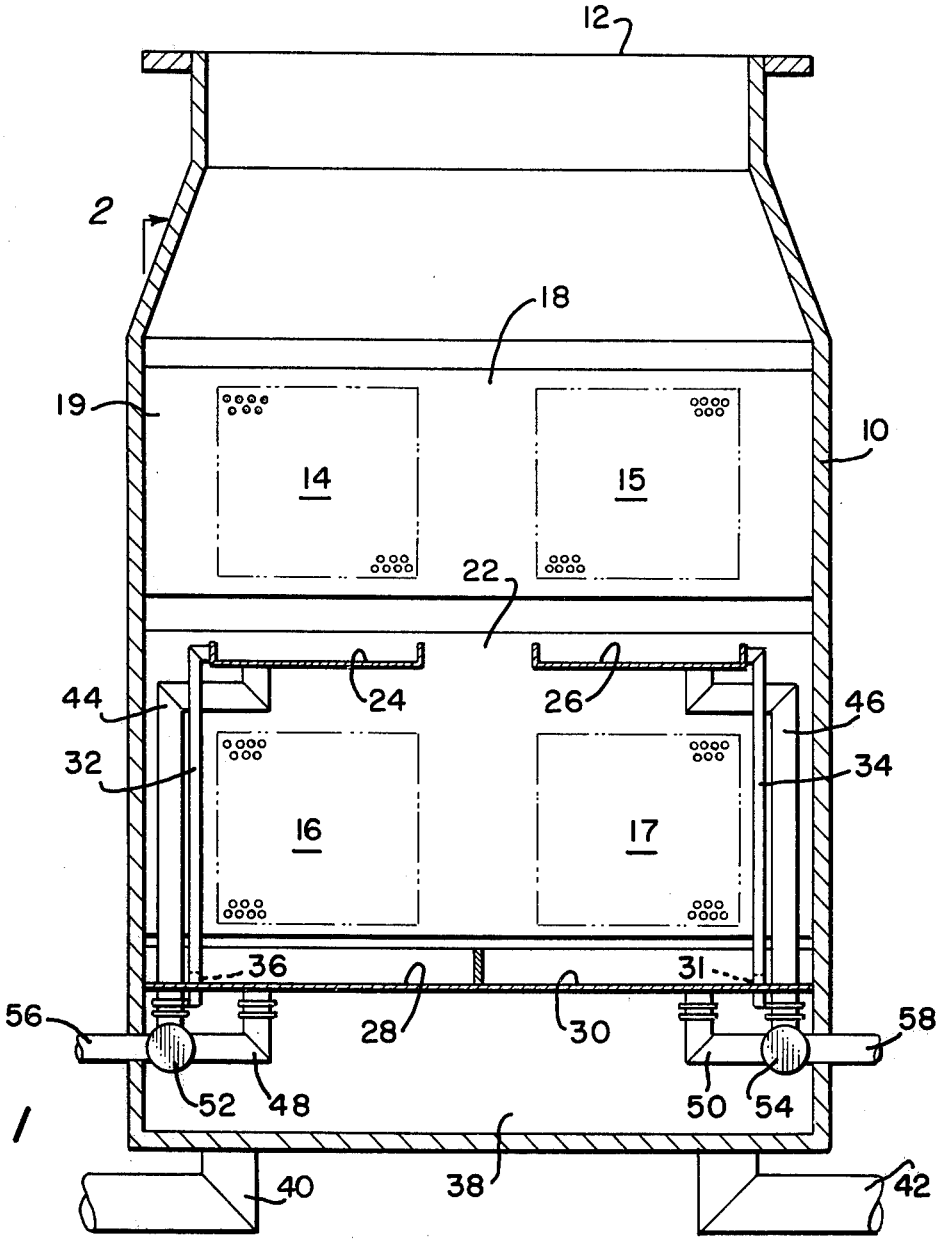
FIG. 1 is an elevational view, partly schematic, and partly in section illustrating my invention.

Referring to the drawings, and more particularly to FIG. 1, the surface condenser includes a housing 10 in which is provided a gas inlet 12. The gas such as steam from a steam turbine is fed into the housing 10 by means of the top gas inlet 12 and conducted over the condenser tube bundles 14, 15, 16, and 17.

Figure 2:
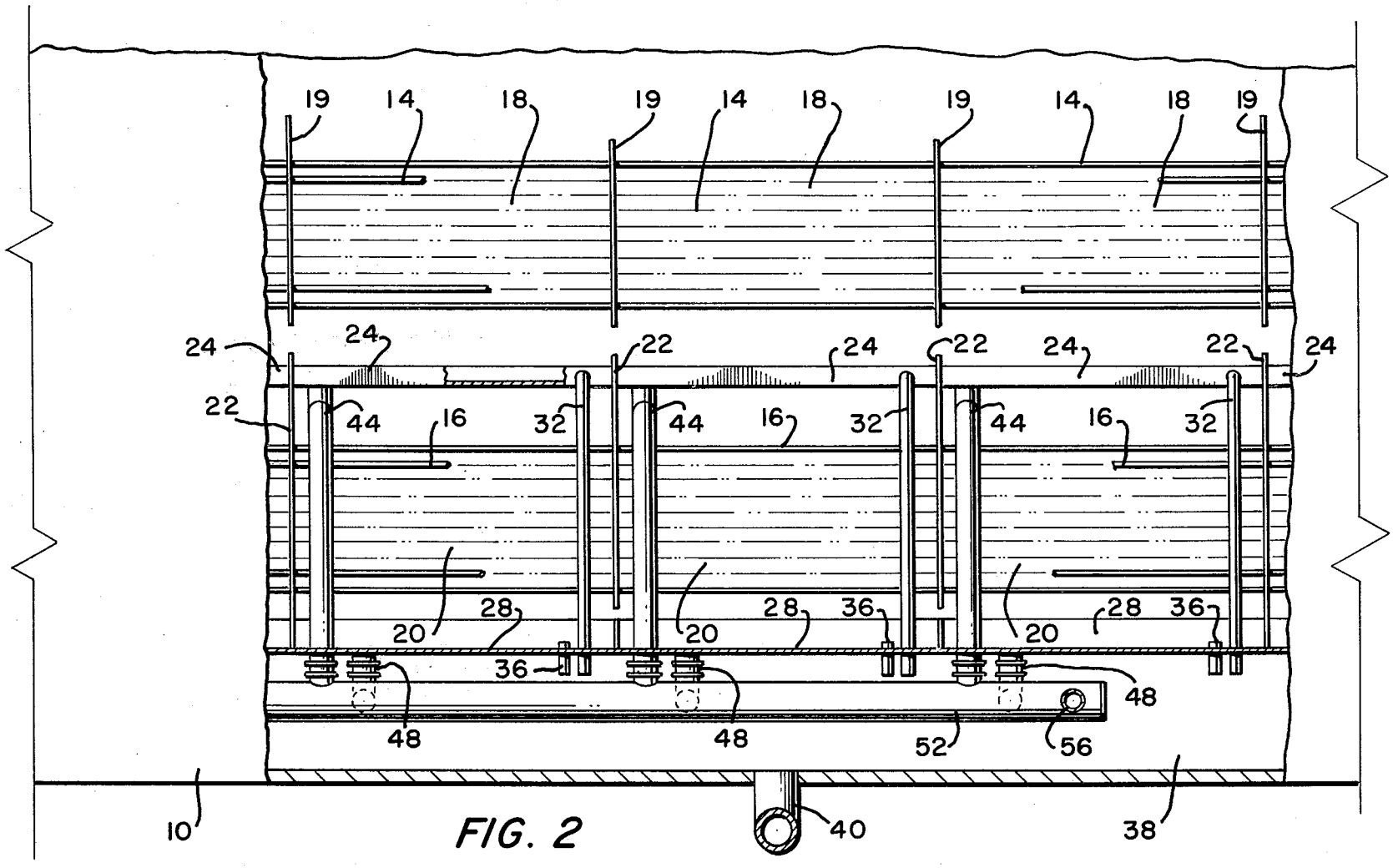
FIG. 2 is a view taken generally along lines 2—2 of FIG. 1 and in the direction of the arrows.

As shown more clearly in FIG. 2, the surface condenser is divided into a plurality of separate compartments located below the steam inlet. There should be at least one group of aligned compartments; and in the preferred embodiment shown there are four groups, two upper groups and two lower groups. The upper compartments 18 are separated by tube support plates 19 with the tube bundle 14 extending through the tube support plates longitudinally through the housing 10. The lower compartments 20 are separated by tube support plates 22 through which the tube bundles 16 extend longitudinally through the lower portion of the condenser housing 10. Similarly, a second upper group (not shown) extends longitudinally through the housing.

A plurality of in-line trays 24 extend below the tube bundles 14. Similarly, a plurality of in-line trays 26, 28, and 30 extend below the tube bundles 15, 16, and 17, respectively (see FIG. 1). In general, the trays form the bottoms of the separate compartments and the condensed steam is collected in the trays.

A first liquid conduit 32 extends from sides of each tray 24. Similarly a first liquid conduit 34 (only one visible in FIG. 1) extends from the sides of each tray 26. A first liquid conduit 36 with its top located above the bottom of the tray 28 extends from each tray 28. A first liquid conduit 31 with its top above the bottom of the tray will also extend from the trays 30.

The liquid conduits 32, 31, 34, and 36, all extend downwardly into the hot well 38. The condensed steam from the hot well 38 is flowed out of the housing 10 through the condensed steam conduits 40 and 42 for re-use.

A second liquid conduit 44 is connected to the bottom of each of the trays 24. Similarly, second liquid conduits 46, 48, and 50 are connected to each of the trays 26, 28, and 30, respectively. All conduits 44, and all conduits 48 are connected to a common internal header 52 extending longitudinally within the housing 10. Similarly all conduits 46 and 50 are connected to a common internal header 54 extending longitudinally within the housing 10. A waste conduit 56 extends from the header 52 to the outside of the housing 10; a waste conduit 58 extends from the header 54 to the outside of the housing 10.

Figure 3:
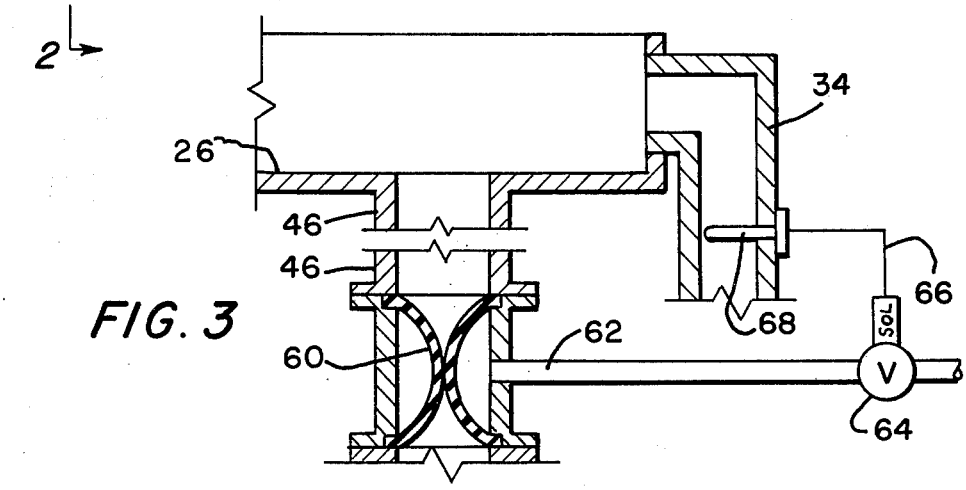
FIG. 3 is a enlarged sectional view showing an electro-pneumatic system for sensing contamination in a compartment of the surface condenser of FIG. 1 and FIG. 2 and opening the normally closed conduit.

FIG. 3 shows in more detail the valve structure and electro-pneumatic system used to control the removal of contamination from one or more separate compartments which may become contaminated. Though FIG. 3 is used to explain the system including the trays 26, first liquid conduit 34 and second liquid conduit 46, the same type of electro-sensitive system is used for each of the other trays and conduits.

The liquid conduit 46 extending downwardly from the bottom of tray 26 is normally closed by an air-operated rubber sleeve valve 60 located in the conduit 46 below the bottom of tray 26. The rubber sleeve valve 60 is maintained in a closed position by means of air fed to the valve 60 through air conduit 62, which is controlled by a normally opened solenoid valve 64.

The solenoid valve 64 is connected through electrical wiring 66 to an electric contamination sensor 68 extending into the first liquid conduit 34.

In operation, condensed steam is fed through the steam inlet 12, over the tube bundles, and condensed. The condensed steam will normally be collected in the trays below the tube bundles and flow through the first liquid conduits extending from the trays, into the hot well, and out of the pipes 40 and 42 for re-use.

In any particular compartment in the condenser becomes contaminated, the contamination will be detected by the electric contamination sensor 68 contained in the normally used liquid conduit, such as liquid conduit 34 shown in FIG. 3. When contamination is detected by the contamination sensor 68, a signal is fed through the wire 66 to solenoid valve 64 to close said valve. Air is no longer fed to the rubber sleeve valve 60, and the sleeve valve will then open. Thereafter, all liquid condensed steam in the particular tray having contamination will flow through the second liquid conduit, such as liquid conduit 46 shown in FIG. 3, into the appropriate header 52 and 54, and fed outside of the housing 10 through the appropriate waste conduit 56 or 58, and thus removed from the steam condenser. The remaining part of the steam condenser, which contains no contamination remains operating in the usual manner.

Of course, though the rubber sleeve valve and electro-pneumatic signal system has particular advantages, it is possible to use other kinds of valves and other kinds of signal systems.

I claim:

1. In a surface condenser having a gas inlet and a condensed gas outlet: a plurality of separate compartments, each containing a plurality of hollow tubes over which the gas is flowed; means for feeding cooling liquid through the tubes to condense the gas; condensed gas collectors located in the separate compartments for collecting condensed gas; a first liquid conduit extending from the condensed gas collectors in each separate compartment to remove the condensed gas from each compartment; a second liquid conduit having a normally closed valve also extending from said condensed gas collectors; a contamination sensor located in each first liquid conduit for sensing any contamination in the liquid flowing through said liquid conduit from the compartment to which the particular liquid conduit is connected; and means responsive to the sensing of contamination by any particular contamination sensor to open the normally closed valve in the particular second liquid conduit extending from the same compartment.

2. The surface container of claim 1 wherein the means responsive to the sensing of contamination by a contamination sensor is electro-pneumatic.

3. The surface condenser in accordance with claim 2 wherein the normally open valve in each second liquid conduit is a pneumatic pressure operated rubber sleeve valve.

4. In a surface condenser having a housing, a steam inlet in the upper part of the housing, and a condensed steam outlet in the lower part of the housing: a plurality of separate compartments located below the steam inlet, said compartments being arranged in at least one group of longitudinally aligned compartments; a plurality of hollow tubes over which the steam is flowed extending through all of the separate compartments; means for feeding cooling liquid through the tubes to condense the steam; a plurality of in-line trays forming the bottoms of said compartments for collecting condensed steam, said trays being arranged above the bottom of the housing to provide a hot well area in the bottom of the housing; a first liquid conduit extending from each tray to the hot-well area; an electric contamination sensor located in each first liquid conduit; a second liquid conduit having a normally closed air-operated rubber sleeve valve also extending from each tray, said second liquid conduits being connected to a common internal header in the housing which in turn is connected to a waste conduit exiting from the housing; and electro-pneumatic means responsive to the sensing of contamination by any particular contamination sensor to open the normally closed rubber sleeve valve in the particular second liquid conduit extending from the same compartment.

* * * * *